US005393483A

United States Patent [19]

Chang

[11] Patent Number: 5,393,483

[45] Date of Patent: Feb. 28, 1995

[54] HIGH-TEMPERATURE FATIGUE-RESISTANT NICKEL BASED SUPERALLOY AND THERMOMECHANICAL PROCESS

[75] Inventor: Keh-Minn Chang, Schenectady, N.Y.

[73] Assignee: General Electric Company, Schenectady, N.Y.

[21] Appl. No.: 502,951

[22] Filed: Apr. 2, 1990

[51] Int. Cl.[6] ..... B22F 3/00; C22C 19/05

[52] U.S. Cl. ..... 419/10; 419/11; 419/29; 419/49; 148/514; 148/677; 148/410; 148/428; 75/252; 75/254; 420/448

[58] Field of Search ..... 420/448; 148/11.5 P, 148/11.5 N, 12.7 N, 410, 428, 514, 677; 75/252, 254, 243, 244, 246; 419/11, 10, 29, 49

[56] References Cited

U.S. PATENT DOCUMENTS

| | | | |
|---|---|---|---|
| 3,850,702 | 11/1974 | Buchanan | 148/11.5 F |
| 3,975,219 | 8/1976 | Allen et al. | 148/11.5 P |
| 4,685,977 | 8/1987 | Chang | 148/12.7 N |
| 4,793,868 | 12/1988 | Chang | 148/11.5 N |
| 4,816,084 | 3/1989 | Chang | 148/13 |
| 4,820,353 | 4/1989 | Chang | 148/2 |

*Primary Examiner*—Donald P. Walsh
*Assistant Examiner*—Ngoclan T. Mai
*Attorney, Agent, or Firm*—James Magee, Jr.

[57] ABSTRACT

A nickel based superalloy composition is disclosed that provides increased high temperature stress-rupture strength and improved resistance to fatigue crack propagation at elevated temperatures up to about 760° C. The composition is comprised of, by weight percent, about 10% to 12% chromium, about 17% to 19% cobalt, about 1.5% to 3.5% molybdenum, about 4.5% to 6.5% tungsten, about 3.25% to 4.25% aluminum, about 3.25% to 4.25% titanium, about 2.5% to 3,5% tantalum, about 0.02% to 0.08% zirconium, about 0.005% to 0.03% boron, less than 0.1% carbon, and the balance essentially nickel. Thermomechanical processing including isothermal forging at controlled strain rates and temperature ranges, supersolvus annealing, and slow cooling are disclosed for producing an enlarged grain structure that provides the improved properties in the alloy of this invention.

14 Claims, 7 Drawing Sheets

100 - HOUR STRESS RUPTURE STRENGTH
CH99
'977 PATENT
RENE 95
STRESS, ksi
160
140
120
100
80
60
650
675
700
725
750
775
800
825
TEMPERATURE, °C

HIGH-TEMPERATURE FATIGUE-RESISTANT NICKEL BASED SUPERALLOY AND THERMOMECHANICAL PROCESS

CROSS REFERENCE TO RELATED APPLICATION

The subject application relates to copending application Ser. No. 07/503,007, filed Apr. 2, 1990, U.S. Pat. No. 5,061,324.

BACKGROUND OF THE INVENTION

This invention relates to powdered nickel based superalloy compositions and to a method including thermomechanical treatments for making articles having improved stress-rupture strength and resistance to time-dependant fatigue crack propagation.

It is well known that nickel based superalloys are extensively employed in high performance environments. Some of these alloys, and particularly alloys used in the rotating parts of gas turbines for aircraft, must exhibit a desirable balance between tensile, creep, and fatigue properties at elevated temperatures of 650° C. or more. It is the creep properties as measured by the stress-rupture strength, and fatigue properties as measured by the resistance to fatigue crack propagation that are of concern in the alloy composition and processing method disclosed herein.

The desirable combination of properties of such alloys at high temperatures are at least in part due to the presence of a precipitate which has been designated as a gamma prime precipitate. More detailed characteristics of the phase chemistry of gamma prime are given in "Phase Chemistries in Precipitation-Strengthening Superalloy" by E. L. Hall, Y. M. Kouh, and K. M. Chang, Proceedings of 41st. Annual Meeting of Electron Microscopy Society of America, August 1983, p. 248.

A problem which has been recognized with many nickel based superalloys is that they are subject to formation of cracks either in fabrication or in use, and that the cracks can initiate or propagate while under stress as during use of the alloys in such structures as gas turbines and jet engines. The propagation or enlargement of cracks can lead to part fracture or other failure.

Fatigue is a process of progressive localized permanent structural change occurring in a material subjected to fluctuating stresses and strains that can culminate in cracks or complete fracture. It is well known that fatigue can cause failure of a material at stresses well below the stress the material is capable of withstanding under static load applications. What has been poorly understood until studies were conducted was that the formation and the propagation of cracks in structures formed from superalloys is not a monolithic phenomena in which all cracks are formed and propagated by the same mechanism, at the same rate, and according to the same criteria. The complexity of crack generation and propagation, and the interdependence of such propagation with the manner in which stress is applied is a subject on which important information has been gathered.

The period during which stress is applied to a member to develop or propagate a crack, the intensity of the stress applied, the rate of application and of removal of stress to and from the member and the schedule of this application was not well understood in the industry until a study was conducted under contract to the National Aeronautics and Space Administration. This study is reported in a technical report identified as NASA CR-165123 issued from the National Aeronautics and Space Administration in August 1980, identified as "Evaluation of the Cyclic Behavior of Aircraft Turbine Disk Alloys" Part II, Final Report, by B. A. Cowles, J. R. Warren and F. K. Hauke, and prepared for the National Aeronautics and Space Administration, NASA Lewis Research Center, Contract NAS3-21379.

A principal unique finding of the NASA sponsored study was that the rate of fatigue crack propagation was not uniform for all stresses applied nor to all manners of applying stress. More importantly, it was found that fatigue crack propagation actually varied with the frequency of the application of stress to the member where the stress was applied in a manner to enlarge the crack. More surprising still, was the finding from the NASA sponsored study that the application of stress at lower frequencies rather than at the higher frequencies previously employed in studies, actually increased the rate of crack propagation. In other words, the NASA study revealed that there was a time dependence in fatigue crack propagation. Further, the time-dependence of fatigue crack propagation was found to depend not on frequency alone but on the time during which the member was held under stress for a so-called hold-time.

The most undesirable time-dependent crack-growth behavior has been found to occur when a hold time is superimposed on a sine wave variation in stress. In such a case, a test sample may be subjected to stress in a sine wave pattern, but when the sample is at maximum stress, the stress is held constant for a hold-time. When the hold-time is completed the sine wave application of stress is resumed. According to this hold-time pattern, the stress is held for a designated hold-time each time the stress reaches a maximum in following the normal sine curve. This hold-time pattern of application of stress is a separate criteria for studying crack growth. This type of hold-time pattern was used in the NASA study referred to above.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma\sqrt{a}$. Under the fatigue condition, the stress intensity in a fatigue cycle represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is a constant which is between 2 and 4. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys.

It has been determined that at low temperatures the fatigue crack propagation rate depends essentially on the intensity at which stress is applied to components and parts of such structures in a cyclic fashion. As is partially explained above, the crack growth rate at elevated temperatures cannot be determined simply as a function of the applied cyclic stress intensity $\Delta K$.

Rather, the fatigue frequency can also affect the propagation rate. The NASA study demonstrated that the slower the cyclic frequency, the faster the crack grows per unit cycle of applied stress. It has also been observed that faster crack propagation occurs when a hold time is applied during the fatigue cycle. Time-dependence is a term which is applied to such cracking behavior at elevated temperatures where the fatigue frequency and hold time are significant parameters. The time-dependence of fatigue crack propagation is thermally activated so that the time-dependence can be significantly magnified at 760° C. as compared to 650° C.

Progress has been made in reducing the time-dependency of fatigue crack propagation rates in nickel based superalloys. For example U.S. Pat. Nos. 4,685,977 and 4,820,353 disclose nickel based superalloy compositions that are formed by traditional cast and wrought methods, and are shown to produce essentially time-independent fatigue crack propagation rates at 650° C. In addition, the '353 patent discloses a supersolvus annealing method, and the '977 patent discloses forging above the solvus temperature and annealing above the recrystallization temperature to produce the time-independent fatigue crack propagation rates at 650° C. U.S. Pat. No. 4,816,084 discloses a method for supersolvus annealing and slow cooling superalloy compositions having a gamma prime strengthening precipitate and prepared by powder metallurgy techniques. Such powder formed superalloys annealed by the method of the '084 patent are shown to produce essentially time-independent fatigue crack propagation rates up to 650° C. The '084 patent is incorporated by reference herein.

To achieve increased engine efficiency and greater performance, constant demands are made for improvements in the strength and temperature capability of the alloys used in aircraft engines. One measure of temperature capability is the stress-rupture strength. A stress-rupture test is performed by applying a static load to a test specimen at an elevated temperature and measuring the time for the sample to fail or rupture. Alloys disclosed in the '977 patent discussed above were compared to Rene 95 by stress rupture testing at 760° C. with a 75 ksi initial load. The alloys of the '977 patent had a rupture life of more than 300 hours as compared to less than 30 hours for Rene 95 samples prepared by powder metallurgy techniques. As used herein, the term ksi stands for kips per square inch or the unit of stress representing 1,000 pounds per square inch.

By stress-rupture testing at various loads and temperatures a given length of time can be determined for which the material will rupture over a range of temperatures and stresses. For example, a graph presenting the 100-hour stress-rupture strength of a material gives the temperature's and corresponding stress-rupture strength's at which the material ruptures after 100 hours in a stress-rupture test. A comparison of temperature capability between samples having different compositions or processing treatments can then be made by comparing the temperature at which the samples have the same 100-hour stress-rupture strength.

This invention specifically relates to superalloy compositions produced by powder metallurgy techniques and focuses on the stress-rupture strength and the time-dependence of fatigue crack propagation. Powder metallurgy refers to the fabrication of essentially fully dense stock or parts from metal powders. Fine metal powders are produced so that either each powder particle or a mixture of powders conforms to a final alloy composition. Loose powder aggregates are mechanically consolidated to form relatively dense compacts that are sintered at a temperature that causes strengthening and growth of interparticle bonds. The intrinsic strength of superalloy powders usually necessitates hot compaction in one or two steps combining the compaction and sintering operation.

It is an object of this invention to provide nickel based superalloy compositions and thermomechanical processes for forming the superalloys to produce essentially time-independent fatigue crack propagation rates and improved stress-rupture strength at elevated temperatures up to about 760° C.

It is another object of this invention to provide nickel based superalloy compositions having increased temperature capability as shown by improved stress-rupture strength at elevated temperatures.

Another object of this invention is to provide superalloy compositions having a crack growth rate as small and as free of time-dependency as possible at temperatures up to about 760° C.

BRIEF DESCRIPTION OF THE DRAWINGS

The following description of the invention will be more readily understood by making reference to the drawings in which.

BRIEF DESCRIPTION OF THE INVENTION

Figure 1:
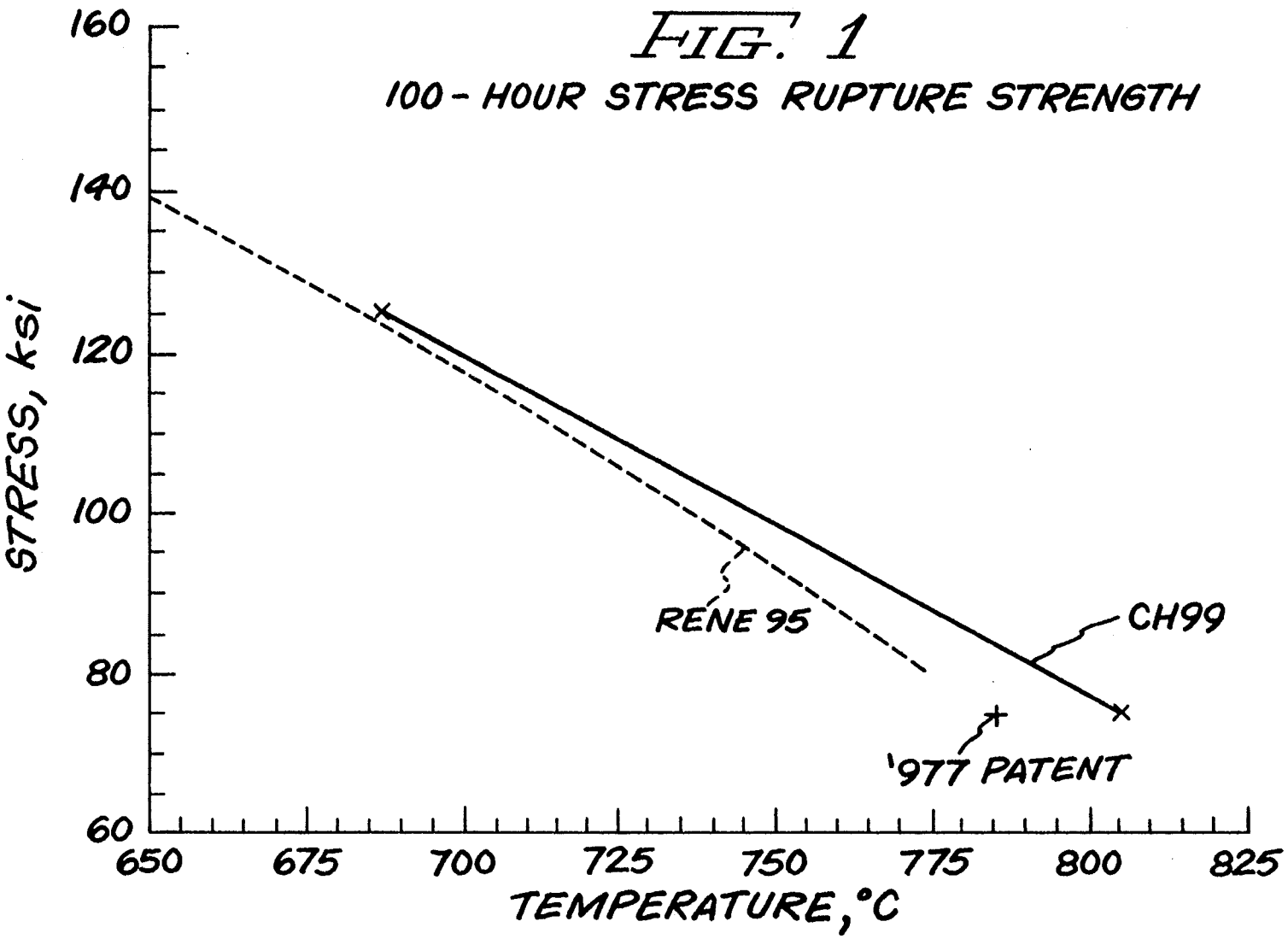
FIG. 1 is a graph of the 100-hour stress-rupture strength of a superalloy disclosed herein, CH99, as compared to Rene 95 and the alloy disclosed in U.S. Pat. No. 4,685,977.

Improved stress-rupture strength and improved resistance to fatigue crack propagation at elevated temperatures up to about 760° C. is provided in a nickel based superalloy comprised of, in weight percent: about 10 to 12 percent chromium, about 17 to 19 percent cobalt, about 1.5 to 3.5 percent molybdenum, about 4.5 to 6.5 percent tungsten, about 3.25 to 4.25 percent aluminum, about 3.25 to 4.25 percent titanium, about 2.5 to 3.5 percent tantalum, about 0.02 to 0.08 percent zirconium, up to about 0.1 percent carbon, about 0.005 to 0.03 percent boron, and balance essentially nickel. The above superalloy is herein referred to as CH99.

Preferably the sum of twice the actual weight of aluminum plus the actual weight of titanium plus one third the actual weight of tantalum is equal to or greater than 12, provided that the actual amounts of titanium, aluminum, and tantalum are within the ranges set forth above. The preferred limitation of aluminum, titanium, and tantalum provides a volume fraction of gamma prime that is at least 45 percent of the volume fraction of all phases present in the microstructure of alloys of this invention for improved stress-rupture strength. The range of compositions shown above provide the improved properties characteristic of the alloys of this invention.

In respect to nickel, the term "balance" or "balance essentially" is used to include, in addition to nickel in the balance of the alloy, small amounts of impurities and incidental elements that may be present and do not adversely affect the increased stress-rupture strength and resistance to fatigue crack propagation of the alloy.

Another aspect of this invention is a method by which the above described alloys are formed into articles characterized by the increased stress-rupture strength and resistance to fatigue crack propagation derived from the alloy composition. Thermomechanical processing conditions, including isothermal forging and subsequent annealing treatments, are used to produce an enlarged grain. The enlarged grain structure is about 50 to 60 microns in size, substantially equiaxed in orientation, and is herein referred to as a growth grain structure. Isothermal forging is performed with heated dies so that during the forging the workpiece being forged is maintained at a substantially constant temperature. Isothermal forging and annealing after forging are performed within temperature ranges below and above the solvus temperature of the alloy.

The solvus temperature, or temperature at which the gamma prime phase is dissolved in the alloy matrix, can be determined by differential thermal analysis as described in "Using Differential Thermal Analysis To Determine Phase Change Temperatures" by J. S. Fipphem and R. B. Sparks, Metal Progress, April, 1979, page 56. A second method for determining the solvus temperature requires the metallographic examination of a series of samples which have been cold reduced about 30 percent and then heat treated at various temperatures around the expected phase transition temperature. At least one of these methods is conducted on samples before subjecting the samples to forging. The solvus temperature of alloy compositions of this invention are in the range of from about 1185° to 1190° C.

Figure 2:
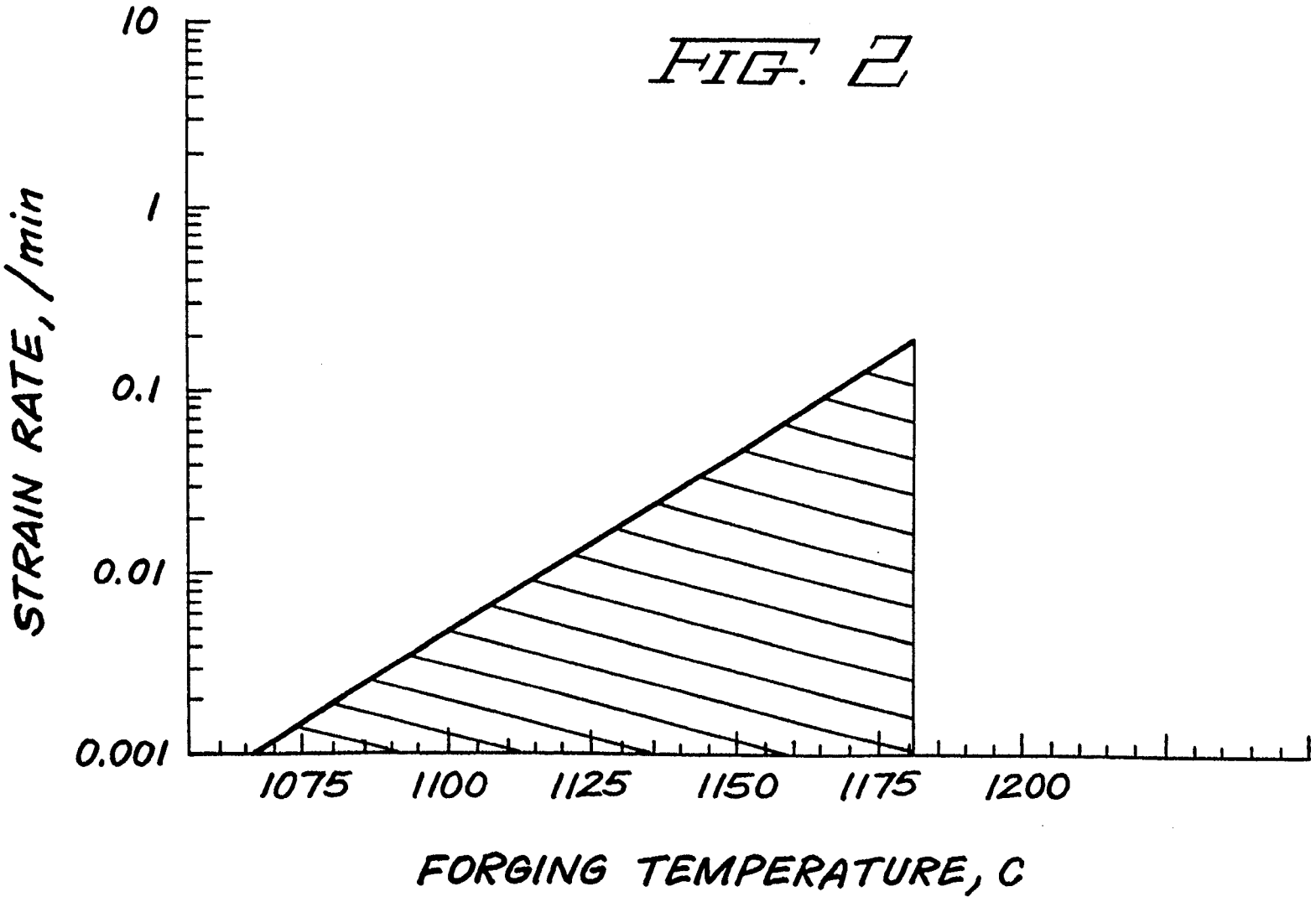
FIG. 2 is a graph showing isothermal forging conditions of strain rate and temperature.

A charge within the range of compositions shown above for CH99 is melted, formed into an alloyed powder and consolidated into a compact by one of the well-known powder metallurgy techniques. The compact is isothermally forged at a temperature and at a rate of straining within the hatched area of FIG. 2 to produce a permanent deformation of at least about 20 percent in the compact. FIG. 2 is a graph showing forging conditions of strain rate, as plotted on the ordinate, and temperature, as plotted on the abscissa.

After forging, the alloy is supersolvus annealed and slow cooled. Supersolvus annealing means heating above the solvus temperature but below the incipient melting temperature of the alloy. Preferably the alloy is supersolvus annealed at about 1190° to 1225° C. and cooled at about 10° to 60° C. per minute. The supersolvus anneal is performed for a period of time sufficient to provide the growth grain microstructure, preferably at least about one hour. A subsequent aging treatment between about 650° to 850° C. for 8 to 64 hours is employed for precipitation strengthening of the alloy. Preferably the aging treatment is about 760° C. for 16 hours to provide the best properties while minimizing the time for the aging treatment.

DETAILED DESCRIPTION OF THE INVENTION

I have discovered a superalloy composition having improved high temperature stress-rupture strength and resistance to fatigue crack propagation up to about 760° C. Thermomechanical processing conditions for providing the improved properties are also disclosed. High temperature stress-rupture strength is increased so that the temperature at which the alloy fails after being stressed at 75 or 80 ksi for 100 hours is increased by about 20° C. over Rene 95 and about 20° C. over the alloy disclosed in the '977 patent. In addition, the resistance to fatigue crack propagation in the alloys of this invention, processed by the method disclosed herein, is shown to be substantially time-independent at temperatures up to 760° C.

An alloyed powder within the composition range of CH99, is produced by any of the well-known powder forming techniques such as gas atomizing. A preferred composition is comprised of, in weight percent: about 11 percent chromium, about 18 percent cobalt, about 2.5 percent molybdenum, about 5.5 percent tungsten, about 3.75 percent aluminum, about 3.75 percent titanium, about 3 percent tantalum, about 0.05 percent zirconium, about 0.05 percent carbon, about 0.02 percent boron, and the balance essentially nickel.

A charge of the desired composition is melted under an inert atmosphere and the melt is atomized by impingement of an inert gas jet against a stream of molten metal. The stream is atomized by this action and upon rapid cooling to the solid state the desired alloyed powder is produced. The powder is screened to remove undesirably large particles. Powders are compacted by hot isostatic pressing with a temperature of about 1125° C. and a pressure of about 15 ksi for about 4 hours.

The powder compact has a fine grain size of 10 microns or less and can be superplastically formed. Superplastic forming in superalloys is a forming condition in which extremely high ductility is obtained at low flow strengths in a fine grained structure. The compact is isothermally forged in a superplastic state to a permanent deformation of at least about 20 percent. However, the isothermal forging conditions are further limited so that the temperature, and the rate of straining are within the hatched area of FIG. 2. I have discovered that by isothermally forging within the rate of straining and temperatures shown by the hatched area of FIG. 2, a desired growth grain microstructure is obtained in the forged article when it is subsequently supersolvus annealed.

The superalloy composition and thermomechanical processes disclosed herein and the improved properties realized are further shown in the following examples.

EXAMPLE 1

An alloy sample, commercially available and sold under the designation Rene 95, was obtained to demonstrate the temperature sensitivity of the time-dependence of fatigue crack propagation as discussed above. Rene 95 is comprised of, by weight percent, about 8.0 percent cobalt, 13.0 percent chromium, 3.5 percent molybdenum, 3.5 percent niobium, 3.5 percent tungsten, 3.5 percent aluminum, 2.5 percent titanium, 0.05 percent zirconium, 0.01 percent boron, 0.06 percent carbon, and the balance nickel. The alloy sample was prepared by powder metallurgy techniques and heat treated by the method of the '084 patent to improve resistance to fatigue crack propagation at temperatures up to 650° C. as shown in the '084 patent. Test samples for fatigue and stress-rupture testing were machined from the processed Rene 95 sample. Rene 95 is known to be the strongest of the nickel based superalloys which is commercially available.

Three fatigue tests were performed on the Rene 95 test samples with the first two tests at 650° C. and the third test at 760° C. Cyclic stress was applied in the first test in three second cycles, and the second and third tests were performed with a three second cycle which was interrupted by a 90 second hold at the maximum stress. These cyclic tests are similar to those employed in the NASA study discussed above. The ratio of the minimum load to the maximum load was set at 0.05 so that the maximum load was twenty times greater than the minimum load. The results of this testing are plotted in FIG. 3.

Figure 3:
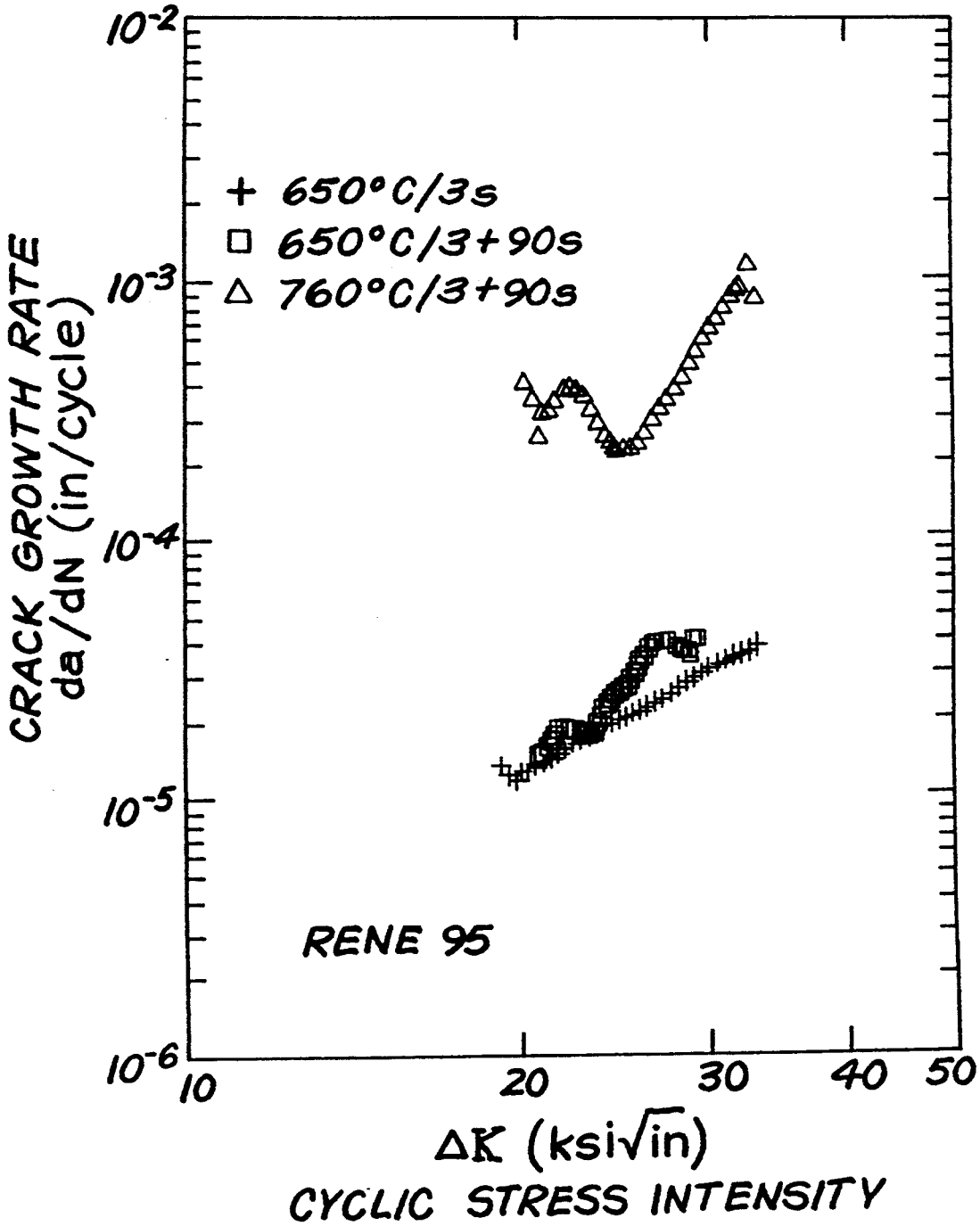
FIGS. 3–7 are graphs showing the fatigue crack growth rates at 650° C. and 760° C. obtained by the application of different stress intensities at 3 second cyclic frequencies with some of the cyclic stress applications including a 90 second hold time at maximum stress intensity.

FIG. 3 shows that the crack growth rate of Rene 95 annealed by the method of the '084 patent is substantially time-independent at the 650° C. test temperature, however, at the 760° C. test temperature the crack growth rate has become time-dependent increasing by about an order of magnitude. This example demonstrates the temperature sensitivity of the time-dependence of the fatigue crack propagation rate which is magnified at 760° C. in Rene 95 processed by the method of the '084 patent.

EXAMPLE 2

The aim composition in Table I was prepared by vacuum induction melting and the molten composition was atomized into powders. Two powder compacts were formed by placing the powder in two separate stainless steel cans that were hot isostatically pressed at a temperature of 1125° C. and pressure of 15 ksi for four hours. The solvus temperature of the composition was determined by metallographic examination as described above. The compacts were thermomechanically processed by various combinations of isothermal forging, supersolvus annealing, and slow cooling conditions. Specific forging, annealing, and slow cooling conditions used on each compact are shown in Table II below. Each compact was forged at a strain rate of 0.075 per minute. Annealed specimen blanks were then machined into test samples.

After forging the compacts were cut into specimen blanks and annealed. Annealed specimen blanks were then machined into test samples for tensile and fatigue testing. Some test samples were used to test the elevated temperature yield strength in conformance with ASTM specification E8 ("Standard Methods of Tension Testing of Metallic Materials", Annual Book of ASTM Standards, Vol. 03.01, pp. 130–150, 1984). Table II also contains the yield strength at 650° C. for alloys of this invention processed according to the conditions shown in Table II.

TABLE II

| Thermomechanical Processing of Samples Prepared in Example 2 | | | | | | |
|---|---|---|---|---|---|---|
| Process No. | Isothermal Forging Temp.(°C.) | One Hour Supersolvus Anneal (°C.) | Cooling Rate (°C./Min.) | 16 Hour Age Harden Anneal (°C.) | Final Grain Size (Microns) | Yield Strength (650° C.) |
| 1 | 1125 | 1200 | 75 | 760 | 20–30 | 156.1 |
| 2 | 1175 | 1200 | 75 | 760 | 50–60 | 149 |
| 3 | 1175 | 1200 | 40 | 760 | 50–60 | 140.8 |
| 4 | 1125 | 1200 | 40 | 760 | 20–30 | 150.3 |

Of the four different processes shown in Table II only process 3 is within the isothermal forging conditions shown as the hatched area in FIG. 2, supersolvus annealing, and slow cooling at a maximum rate of 60° C./minute disclosed as the process of this invention.

Figure 4:
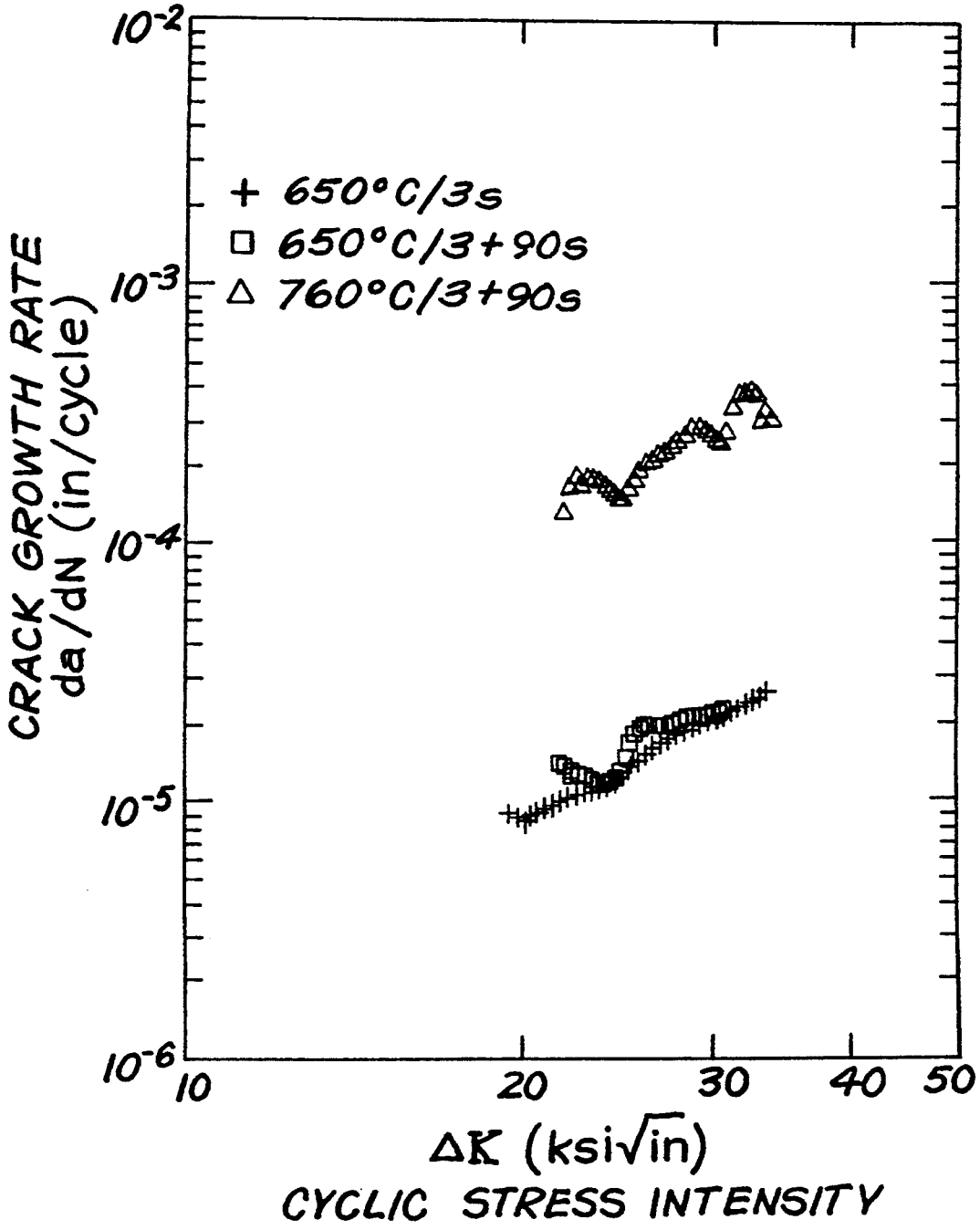

The same cyclic testing at 650° C. and 760° C. performed in Example 1 was performed on the test samples prepared in Example 2. Results of the cyclic stress testing of test samples prepared by processes 1,2,3, and 4 are shown in FIGS. 4–7. In FIG. 4, the test samples prepared according to process 1 show a return to time-dependent fatigue crack propagation rates when the test temperature is increased from 650° C. to 760° C. Test samples treated by process 1 had a combination of forging temperature and strain rate outside the hatched area in FIG. 2, were cooled after supersolvus annealing at a rate about 15° C. above the 60° C./min. maximum cooling rate, and after annealing exhibited a grain size of 20 to 30 microns, less than the desired growth grain size of 50 to 60 microns.

Figure 5:
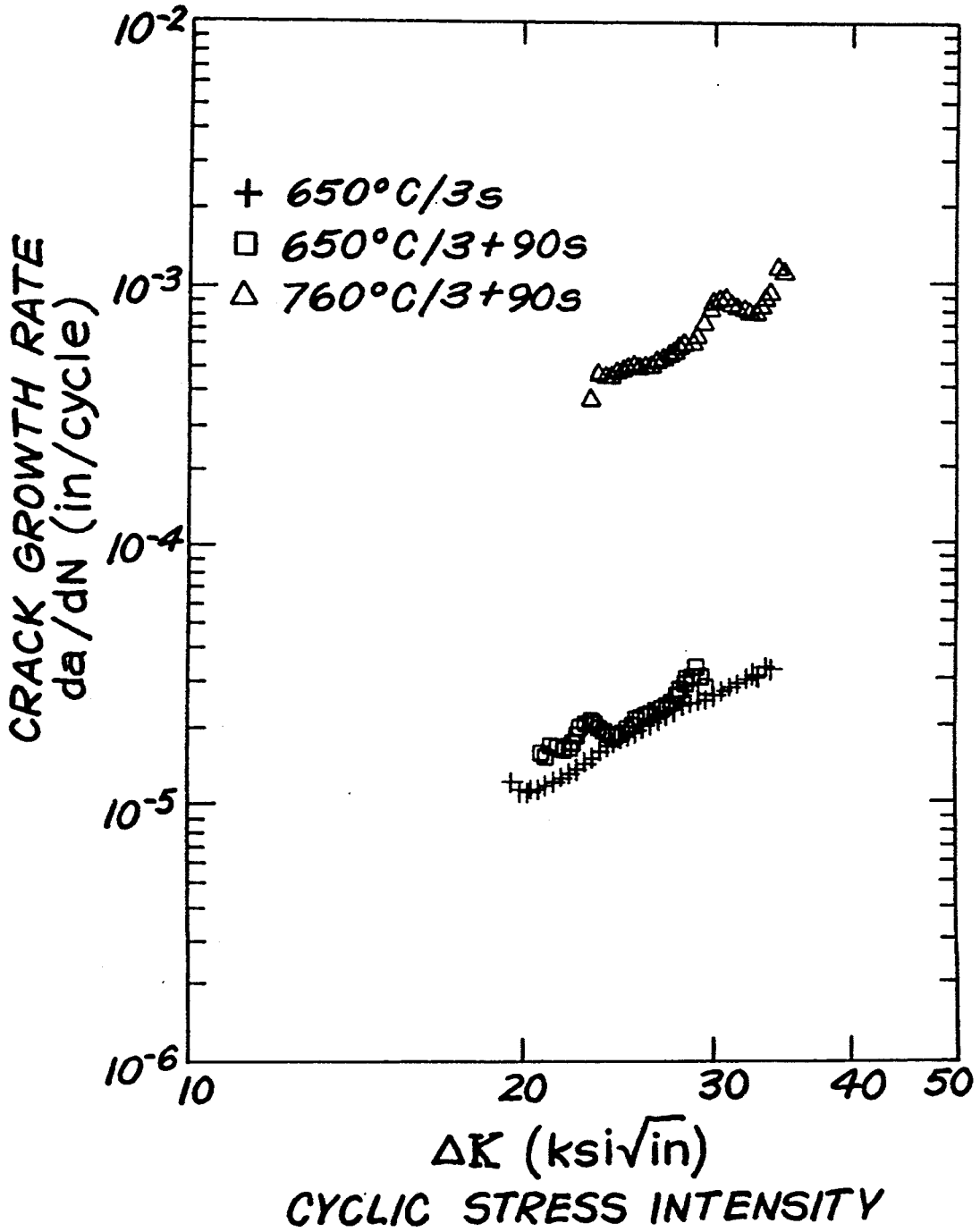

FIG. 5 shows the test samples prepared according to process 2 have a return to time-dependent fatigue crack propagation rates when testing temperature is increased from 650° C. to 760° C. Test samples treated by process 2 had a combination of forging temperature and strain rate within the hatched area of FIG. 2 and exhibited the desired growth grain size of 50–60 microns, but were cooled after supersolvus annealing at a rate about 15° C. above the 60° C. per minute maximum cooling rate specified in the method of this invention.

Figure 6:
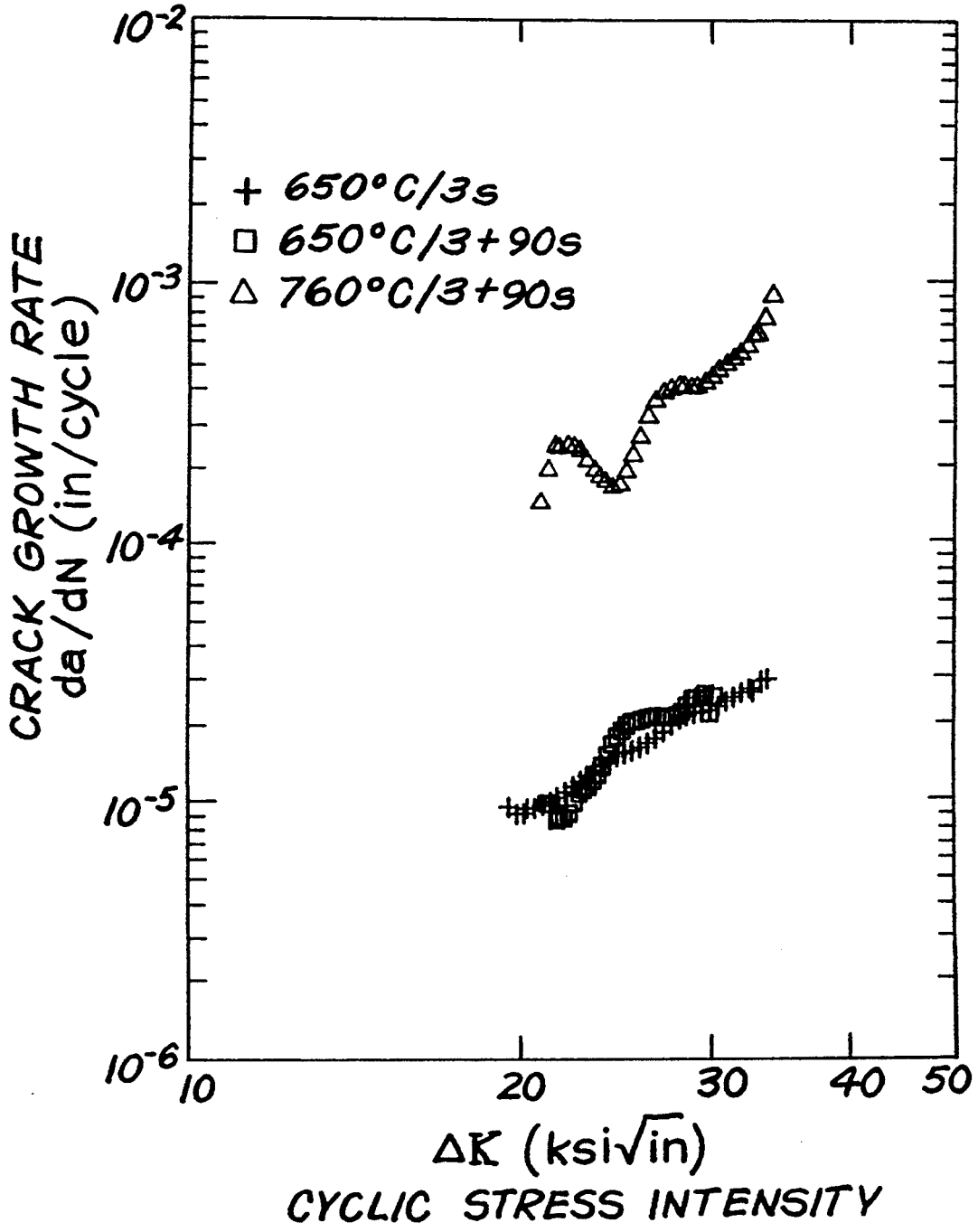

FIG. 6 shows the test samples prepared according to process 4 exhibit a return to time-dependent fatigue crack propagation rates when the test temperature is increased from 650° C. to 760° C. Test samples treated by process 1 had a cooling rate below the 60° C. per minute maximum cooling rate specified in the method of this invention, but had a combination of forging temperature and strain rate outside the hatched area in FIG. 2, and after annealing exhibited a grain size of 20 to 30 microns, less than the desired growth grain size of 50 to 60 microns.

Figure 7:
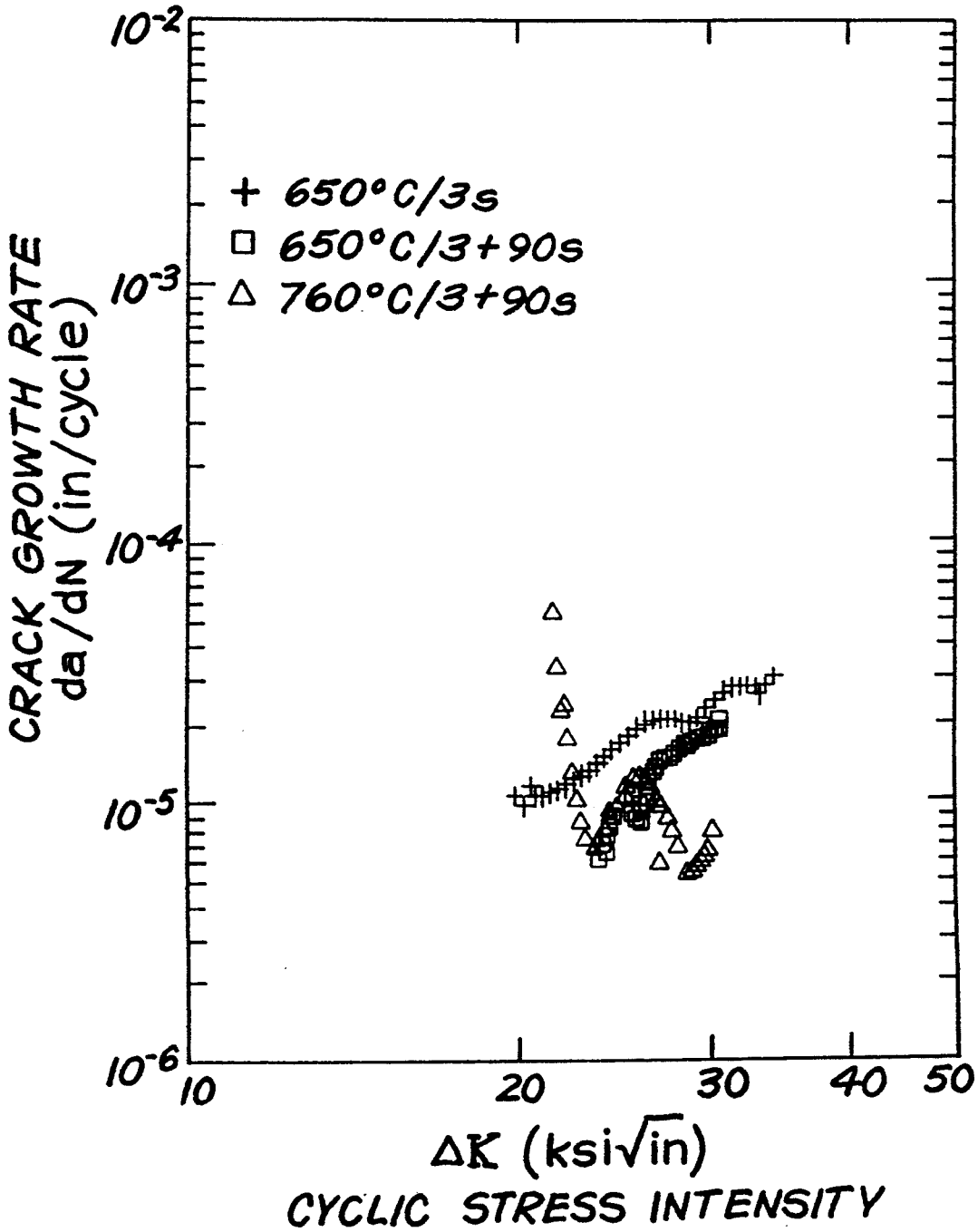

FIG. 7 shows that the test samples prepared according to process 3 exhibit a substantially time-independent fatigue crack propagation rate when the testing temperature is increased from 650° C. to 760° C. Test samples treated by process 3 had a combination of forging temperature and strain rate within the hatched area of FIG. 2, exhibited the desired growth grain size of 50–60 microns, and were cooled after supersolvus annealing at a rate below the 60° C. per minute maximum cooling rate specified in the method of this invention. When alloy compositions of this invention are processed according to the method of this invention as described above, a time-independent fatigue crack propagation rate is found at temperatures up to 760° C.

EXAMPLE 3

The improved stress-rupture strength of the superalloy compositions disclosed herein as CH99 is shown in Example 3. Some of the test samples prepared in Example 1 and test samples prepared in Example 2 and processed according to process 3 were subjected to stress-rupture testing at various temperatures and initially applied stresses in conformance with ASTM specification E 139, "Standard Practice for Conducting Creep, Creep-Rupture, and Stress-Rupture Tests of Metallic Materials," 1989 Annual Book of ASTM Standards, vol.3.01, pp. 313–323, or equivalent.

FIG. 1 is a graph of 100-hour stress-rupture strength's as a function of initially applied stress, plotted on the ordinate, and test temperature, plotted on the abscissa. The 100-hour stress-rupture strength's were determined from the stress-rupture testing of the Rene 95 test samples and the test samples of CH99 prepared by process 3 in Table II. For comparison, the 100-hour stress-rupture strength disclosed for the superalloy in the '977 patent is also plotted on FIG. 1. A comparison of temperature capability is made by comparing the temperature at which alloys of this invention, Rene 95, and the alloy disclosed in the '977 patent have the same 100-hour stress-rupture strength.

As shown in FIG. 1, at about 774° C. Rene 95 has a 100-hour stress-rupture strength of 80 ksi, while the compositions disclosed herein have a 100-hour stress-rupture strength of 80 ksi at about 795° C., an improvement of about 20° C. At about 785° C. the alloy disclosed in the '977 patent has a 100-hour stress-rupture strength of 75 ksi, while the compositions disclosed herein have a 100-hour stress-rupture strength of 75 ksi at about 805° C., an improvement of about 20° C.

In practicing the present invention, care should be exercised in the cooling of a specimen which has been supersolvus annealed. In the examples above it is shown that the rate of cooling affects the properties of the specimen relating to fatigue crack propagation and lower rates of cooling reduce fatigue crack propagation. At the same time, it is shown by the yield strengths in Table II that very slow cooling rates can result in lower levels of strength in the alloy.

As has also been taught above, aging treatments following treatments from a supersolvus anneal can be employed to enhance alloy strength. The rate of cooling from a supersolvus anneal can be modified to provide a needed degree of freedom from time-dependent fatigue crack propagation and at the same time preserve much of the inherent strength of the alloys of this invention. The best balance of strength properties with inhibition of fatigue crack propagation can be determined from a few tests conducted in a manner similar to those described with respect to the above examples.

What is claimed is:

1. A powdered nickel based superalloy consisting essentially of: in weight percent, about 10 to 12 percent chromium, about 17 to 19 percent cobalt, about 1.5 to 3.5 percent molybdenum, about 4.5 to 6.5 percent tungsten, about 3.25 to 4.25 percent aluminum, about 3.25 to 4.25 percent titanium, about 2.5 to 3.5 percent tantalum, about 0.02 to 0.08 percent zirconium, up to about 0.1 percent carbon, about 0.005 to 0.03 percent boron, and balance essentially nickel, the superalloy having improved stress-rupture strength and resistance to fatigue crack propagation at 1400° C.

2. The superalloy of claim 1 wherein the sum of twice the actual weight of aluminum plus the actual weight of titanium plus one third the actual weight of tantalum is equal to or greater than 12.

3. The superalloy of claim 1 consisting essentially of: in weight percent, about 11 percent chromium, about 18 percent cobalt, about 2.5 percent molybdenum, about 5.5 percent tungsten, about 3.75 percent aluminum, about 3.75 percent titanium, about 3 percent tantalum, about 0.05 percent zirconium, about 0.05 percent carbon, about 0.02 percent boron, and the balance essentially nickel.

4. A method of preparing an article from a compact of a powdered nickel base superalloy having a gamma prime strengthening precipitate to increase the resistance to fatigue cracking in the article, comprising:

forming the compact from the powdered superalloy composition consisting essentially of, by weight percent, about 10 to 12 percent chromium, about 17 to 19 percent cobalt, about 1.5 to 3.5 percent molybdenum, about 4.5 to 6.5 percent tungsten, about 3.25 to 4.25 percent aluminum, about 3.25 to 4.25 percent titanium, about 2.5 to 3.5 percent tantalum, about 0.05 zirconium, about 0.05 carbon, about 0.02 boron, and balance essentially nickel;

isothermally forging the compact at a rate of straining and within a range of temperatures shown by the hatched area in FIG. 2, to produce a permanent deformation of at least about 20 percent;

supersolvus annealing the forged compact at a temperature above about 1190° C. but below the incipient melting temperature of the alloy, for a period of time that essentially completely dissolves the gamma prime precipitate; and slowly cooling the alloy from the supersolvus temperature.

5. The method of claim 4 wherein the sum of twice the actual weight of aluminum plus the actual weight of titanium plus one third the actual weight of tantalum is equal to or greater than 12.

6. The method of claim 4 additionally comprising the step of aging the alloy at about 650° to 850° C. for about 8 to 64 hours.

7. The method of claim 4 wherein the alloy is cooled at a rate of about 60° C. per minute or less.

8. The method of claim 4 wherein the alloy is supersolvus annealed between about 1190° to 1225° C.

9. The method of claim 4 wherein the alloy is supersolvus annealed for at least one hour.

10. A method for increasing the resistance to fatigue cracking in articles manufactured from a compact of nickel based superalloy powders having a nickel base superalloy matrix and a gamma prime strengthening precipitate, comprising:

forming the compact from the powdered superalloy composition consisting essentially of, in weight percent, about 10 to 12 percent chromium, about 17 to 19 percent cobalt, about 1.5 to 3.5 percent molybdenum, about 4.5 to 6.5 percent tungsten, about 3.25 to 4.25 percent aluminum, about 3.25 to 4.25 percent titanium, about 2.5 to 3.5 percent tantalum, about 0.05 zirconium, about 0.05 carbon, about 0.02 boron, and balance essentially nickel;

isothermally forging the compact at a temperature between about 1070° to 1180° C. to produce a permanent deformation of at least about 20 percent, the forging being performed at a strain rate that maintains a fine grain size allowing superplastic forming during forging and introduces sufficient deformation in the grains to cause grain growth to about 50 to 60 microns during a subsequent supersolvus anneal;

supersolvus annealing the forged superalloy at a temperature above about 1190° C. for a period of time that essentially completely dissolves the gamma prime precipitate; and slowly cooling the alloy from the supersolvus temperature.

11. The method of claim 10 wherein the sum of twice the actual weight of aluminum plus the actual weight of titanium plus one third the actual weight of tantalum is equal to or greater than 12.

12. The method of claim 10 wherein the alloy is cooled at a rate of about 60° C. per minute or less.

13. The method of claim 10 wherein the alloy is supersolvus annealed for at least one hour.

14. The method of claim 10 additionally comprising the step of aging the alloy at about 650° to 850° C. for about 8 to 64 hours.

* * * * *